US006962141B2

(12) United States Patent
Kern

(10) Patent No.: US 6,962,141 B2
(45) Date of Patent: Nov. 8, 2005

(54) FUEL INJECTOR COMPRISING BOOSTER FOR MULTIPLE INJECTION

(75) Inventor: Volkmar Kern, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/503,440

(22) PCT Filed: Apr. 3, 2003

(86) PCT No.: PCT/DE03/01097

§ 371 (c)(1),
(2), (4) Date: Aug. 4, 2004

(87) PCT Pub. No.: WO2004/003378

PCT Pub. Date: Jan. 8, 2004

(65) Prior Publication Data

US 2005/0103310 A1 May 19, 2005

(30) Foreign Application Priority Data

Jun. 29, 2002 (DE) ..... 102 29 412

(51) Int. Cl.[7] ..... F02M 37/04
(52) U.S. Cl. ..... 123/446; 123/467
(58) Field of Search ..... 123/446, 447, 123/467, 500, 501, 456

(56) References Cited

U.S. PATENT DOCUMENTS 5,622,152 A * 4/1997 Ishida ..... 123/446
6,604,507 B1 * 8/2003 Lei et al. ..... 123/446
6,619,263 B1 9/2003 Mahr et al.
6,634,336 B1 * 10/2003 Kropp ..... 123/467
6,883,498 B2 * 4/2005 Braun et al. ..... 123/446
6,892,703 B2 * 5/2005 Magel ..... 123/446
6,895,935 B2 * 5/2005 Braun et al. ..... 123/446
2004/0025845 A1 2/2004 Magel
2004/0089269 A1 * 5/2004 Braun et al. ..... 123/446
2004/0149265 A1 8/2004 Magel et al.
2004/0231645 A1 * 11/2004 Magel ..... 123/446

FOREIGN PATENT DOCUMENTS

DE 199 39 422 A1 3/2001
DE 101 23 911 A1 11/2002
DE 101 23 914 A1 11/2002

* cited by examiner

*Primary Examiner*—Carl S. Miller
(74) *Attorney, Agent, or Firm*—Ronald E. Greigg

(57) ABSTRACT

A device for injecting fuel into the combustion chamber of an internal combustion engine, a high-pressure accumulator, a pressure booster, and a metering valve. The pressure booster has a working chamber and a control chamber that are separated from each other by an axially moving piston. A pressure change in the control chamber of the pressure booster causes a pressure change in a compression chamber of the pressure booster. The compression chamber communicates with a hydraulic chamber that acts on an injection valve element. The piston that acts on the compression chamber of the pressure booster is provided with control sections that can be used to relieve the pressure in the hydraulic chamber of the injection valve element.

16 Claims, 1 Drawing Sheet

FUEL INJECTOR COMPRISING BOOSTER FOR MULTIPLE INJECTION

CROSS-REFERENCE TO RELATED APPLICATIONS

This application is a 35 USC 371 application of PCT/DE 03/01097 filed on Apr. 03, 2003.

BACKGROUND OF THE INVENTION

1. Field of the Invention

Both pressure-controlled and stroke-controlled injection systems can be used to supply fuel to combustion chambers of autoignition internal combustion engines. In addition to unit injectors and unit pumps, accumulator injection systems are also used as fuel injection systems. Accumulator (common rail) injection systems advantageously make it possible to adapt the injection pressure to the load and speed of the engine. Achieving high specific outputs and reducing emissions of the autoignition engine generally require the highest injection pressure possible.

2. Prior Art

For strength reasons, the achievable pressure level in accumulator injection systems currently in use is limited to approximately 1600 bar at this time. Pressure boosters are employed to further increase the pressure in accumulator injection systems.

EP 0 562 046 B1 has disclosed an actuator/valve apparatus with damping for an electronically controlled injection unit. The actuator/valve apparatus for a hydraulic unit has an electrically excitable electromagnet with a fixed stator and a moving armature. The armature has a first and a second surface. which delimit a first and second cavity, the first surface being oriented toward the stator. A valve is provided, which is connected to the armature in a position to convey a hydraulic actuation fluid from a sump to the injection device. A damping fluid can either be collected in one of the cavities of the electromagnet device or drained from it. A region of a valve that protrudes into a central bore can selectively open and close the flow connection of the damping fluid in proportion to its viscosity.

DE 101 23 910.6 relates to a fuel injection apparatus used in an internal combustion engine. Fuel injectors supply fuel to the combustion chambers of the engine. The fuel injectors are acted on by means of a high-pressure source; the fuel injection apparatus according to DE 101 23 910.6 also includes a pressure booster that has a moving pressure booster piston, which divides a chamber that can be connected to the high-pressure source from a high-pressure chamber connected to the fuel injector. The fuel pressure in the high-pressure chamber can be varied by filling a return chamber of the pressure booster with fuel or by emptying fuel from this return chamber.

The fuel injector has a moving closing piston for opening and closing the injection openings that are oriented toward the combustion chamber. The closing piston protrudes into a closing pressure chamber so that it can be acted on with fuel pressure. This generates a force that acts on the closing piston in the closing direction. The closing pressure chamber and an additional chamber constitute a common working chamber; all of the partial regions of the working chamber are permanently connected to each other to permit the exchange of fuel.

With this design, triggering the pressure booster via the return chamber makes it possible to keep the triggering losses in the high-pressure fuel system low in comparison to a triggering by means of a working chamber that is intermittently connected to the high-pressure fuel source. In addition, the high-pressure chamber can only be pressure-relieved down to the pressure level of the high-pressure accumulator and not down to the leakage pressure level. On the one hand, this improves the hydraulic efficiency and on the other hand, permits a more rapid pressure increase up to the system pressure level so that the time intervals between injection phases can be reduced.

Pressure-controlled common rail injection systems with pressure boosters have the problem of not assuring the stability of the injection quantities to be injected into the combustion chamber, in particular the production of very small injection quantities of the kind required in preinjections. This is primarily due to the fact that the nozzle needle opens very quickly in pressure-controlled injection systems. As a result, very small variations in the triggering duration of the control valve can have powerful effects on the fuel quantity. Attempts have been made to remedy this problem by providing a separate needle stroke damper piston that delimits a damping chamber and must be guided in a high-pressure-tight clearance fit. This design does in fact permit a reduction of the needle opening speed, but on the other hand, it sharply increases the structural complexity and therefore the costs of the injection system.

In view of the ever-increasing standards regarding emissions and noise generation in autoignition internal combustion engines, further steps must be taken in the injection system in order to meet the stricter limit values to be expected in the near future.

In order to achieve the most flexible injection possible, systems with two solenoid valves have been developed. But since using two solenoid valves is complex and expensive, it would be desirable to use only one solenoid valve per injector/pressure booster combination. So far, a system of this kind has been controlled by means of a 3/2-way valve in order to produce multiple injections. These valves are complex in design and are difficult to manufacture with the required precision in series production because of the strict tolerances required.

SUMMARY OF THE INVENTION

The fuel injector with pressure booster proposed according to the invention makes it possible to execute multiple injections into the combustion chamber of an autoignition internal combustion engine by means of control sections provided on a pressure booster piston. These, in combination with a 2/2-way valve for actuating the pressure booster, i.e. in order to increase pressure in a compression chamber and relieve pressure in a control chamber, make it possible to execute multiple injections at a high pressure level. It is thus possible to eliminate the use of a 3/2-way valve, which is rather unsuited to the mass production of injector components, is difficult to produce within the required tolerances, and involves high costs.

Control sections on a rotationally symmetrical component such as a pressure booster piston can be produced inexpensively in terms of the precision requirements; moreover, the 2/2-way valve used in the pressure boosted fuel injector has a relatively simple design that is not susceptible to malfunction.

In order to produce extremely small preinjection quantities to be injected into the combustion chamber of the internal combustion engine during a preinjection phase, the control sections provided on the pressure booster piston can be embodied as very narrow in terms of their axial length, i.e. in the stroke direction of the pressure booster piston. The geometry of the control sections can be used to produce another preinjection phase that, depending on the design of the control sections, can be shorter or longer than a preceding first preinjection phase, for example. Instead of an additional preinjection phase that follows a first preinjection phase, a corresponding design of the control sections can also inexpensively achieve a longer main injection phase into the combustion chamber of the internal combustion engine.

BRIEF DESCRIPTION OF THE DRAWING

The invention will be explained in detail below in conjunction with the single drawing figure which shows the hydraulic connection diagram of a fuel injector embodied according to the invention, in which the working chamber of a pressure booster connected upstream can be acted on with highly pressurized fuel by means of a high-pressure accumulator (common rail).

DESCRIPTION OF THE PREFERRED EMBODIMENTS

Figure 1:
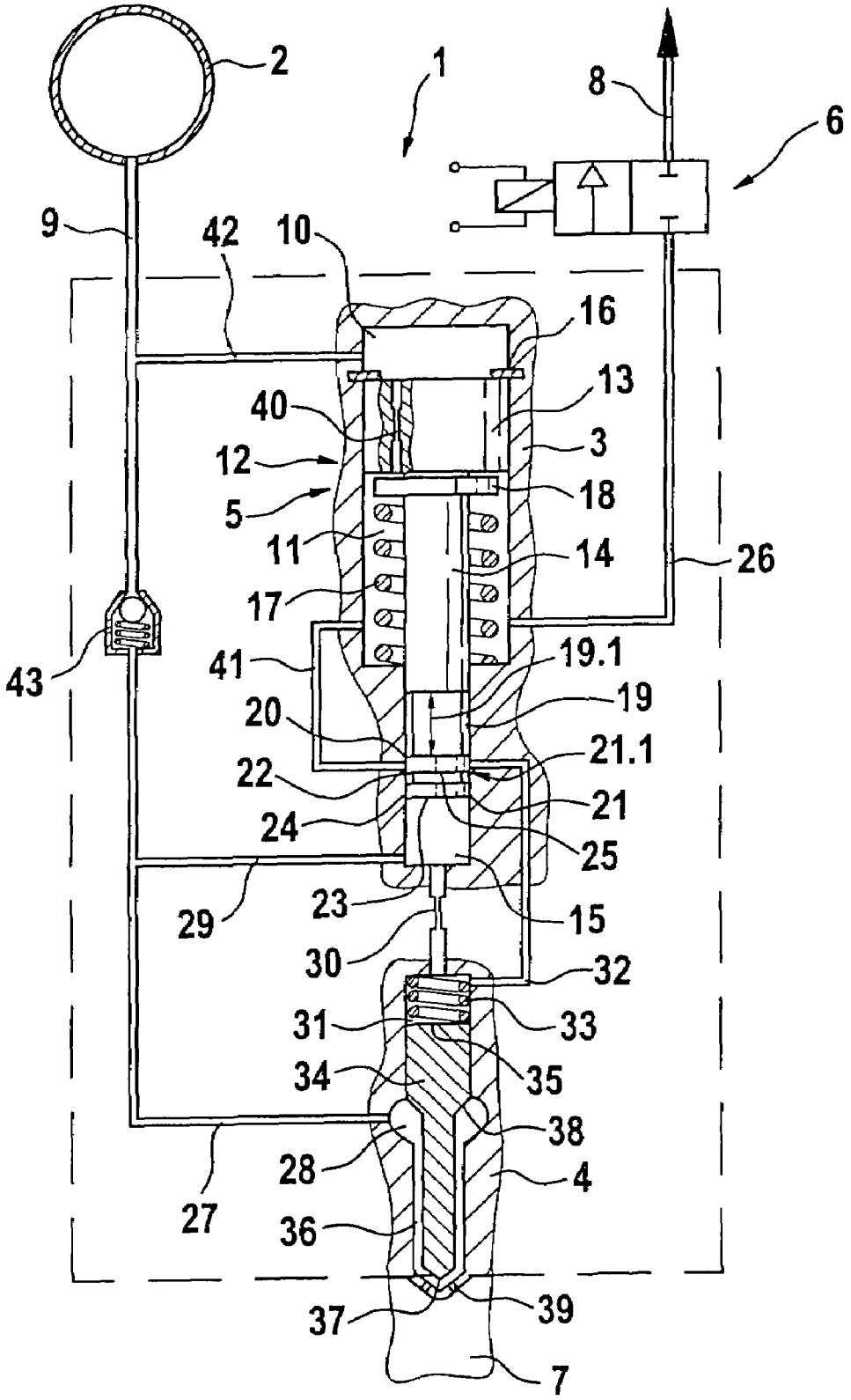

The drawing shows a device for injecting fuel, with a fuel injector that has a pressure booster connected upstream of it and can be actuated by means of a metering valve embodied in the form of a 2/2-way valve.

According to the hydraulic connection diagram of a fuel injector 1 shown in FIG. 1, the fuel injector has a high-pressure accumulator 2, a pressure booster 5, and a metering valve 6 preferably embodied in the form of a 2/2-way valve. The pressure booster 5 has an injection valve connected downstream of it, whose injection valve element 34 can be actuated by means of a hydraulic chamber 31 and a nozzle chamber 28.

A supply line 9 branches from the high-pressure accumulator 2 (common rail) and has an inlet 42 to a working chamber 10 of the pressure booster 5. In addition to the working chamber 10, the pressure booster 5 has a control chamber 11. The working chamber 10 of the pressure booster 5 is divided from the control chamber 11 of the pressure booster 5 by a piston 12, which in the embodiment variant according to FIG. 1 has a first piston part 13 with a larger diameter and a second piston part 14 with a smaller diameter. The first piston part 13 and the second piston part 14 can be embodied as separate components; in a modification of the design of the piston 12 shown in FIG. 1, the first piston part 13 and the second piston part 14 can also be embodied as being of one piece with each other.

The second piston part 14 of the piston 12 inside the pressure booster 5 is acted on by a spring element 17 preferably embodied in the form of a coil spring, which is supported at one end against the bottom of the control chamber 11 of the pressure booster 5 and is supported at the other end against a spring stop 18 in the upper region of the second piston part 14. The pressure booster 5 also has a stop, e.g. embodied in the form of a support ring 16, for the upper end surface of the first piston part 13 of the piston 12.

The control chamber 11 of the pressure booster 5 communicates via a control line 26 with the metering valve 6 preferably embodied in the form of a 2/2-way valve; when it is switched from the closed position shown in FIG. 1 into the open position, this discharges the pressure in the control chamber 11 into a low-pressure return 8. The metering valve 6 embodied in the form of a 2/2-way valve can either be a solenoid valve or can be actuated by a piezoelectric actuator.

The 2/2-way valve according to the embodiment variant shown in FIG. 1 can also be embodied as a servo valve or as a valve that is acted on directly. The control chamber 11 of the pressure booster also communicates via an overflow line 41 with a compression chamber 15 in the lower region of the pressure booster 5. At the same level that the overflow line 41 is connected to a junction point 24, the compression chamber 15 of the pressure booster 5 also has a connecting line 32 branching from it, which connects the compression chamber 15 of the pressure booster 5 to a hydraulic chamber 31, which acts on an injection valve element 34 that can preferably be embodied in the form of a nozzle needle. Parallel to the connecting line 32 between the hydraulic chamber 31 and the compression chamber 15, an additional line that contains a throttle restriction 30 also connects the compression chamber 15 to the hydraulic chamber 31. The compression chamber 15 is filled via a branch 29 that branches off from the supply line 9 leading from the high-pressure accumulator 2, downstream of a check valve 43 contained in the supply line 9. The supply line 9, which contains the check valve 43 that damps pressure pulsations and pressure wave reflections in order to prevent negative repercussions these pulsations might have on the interior of the high-pressure accumulator 2, has a fuel inlet 27 branching from it that leads into a nozzle chamber 28. The nozzle chamber 28, is embodied inside a nozzle body 4 of the fuel injector 1 and encompasses the injection valve element 34 in the form of a ring. The outer circumference of the injection valve element 34 is provided with a pressure shoulder 38 in the region of the nozzle chamber 28.

The hydraulic chamber 31 contains a spring element 33 embodied in the form of a coil spring that is supported at one end against the top of the hydraulic chamber 31 and is supported at the other end against the end surface 35 of the injection valve element 34. The nozzle chamber 28 encompassing the injection valve element 34 in the region of a pressure shoulder 38 has an inlet embodied in the form of an annular gap 36 extending from it in the direction of the needle tip 37. A seat of the injection valve element 34, which is disposed at the combustion chamber end, is provided at the needle tip 37 of the injection valve element 34. This seat at the needle tip 37 of the injection valve element 34, which is embodied for example in the form of a conical seat, opens and closes injection openings 39 that feed into a combustion chamber 7 of an autoignition internal combustion engine, which openings can be embodied as double rows of openings or as a single row of openings arranged in a circular pattern and serve to atomize the fuel as it enters the combustion chamber 7 of the autoignition internal combustion engine.

The line 9 communicates the pressure prevailing inside the high-pressure accumulator 2 to the working chamber 10 of the pressure booster. In the normal state of the fuel injector 1 according to the invention, i.e. the idle state, the metering valve 6 preferably embodied in the form of a 2/2-way valve is not actuated and no injection occurs. In this state, the pressure prevailing in the high-pressure accumulator 2 (common rail) and in the working chamber 10 of the pressure booster 5 communicates with the metering valve 6 via the working chamber 10, a throttle restriction 40 in the first piston part 13, the control chamber 11, and the control line 26. The pressure prevailing inside the high-pressure accumulator 2 also prevails in the control chamber 11 of the pressure booster 5 via the throttle restriction 40 in the first piston part 13. The pressure prevailing inside the high-pressure accumulator 2 is also communicated to the nozzle chamber 28 of the injector body 4 via the fuel inlet 27 and via the check valve 43 provided in the supply line 9; the hydraulic chamber 31 acting on the end surface 35 of the injection valve element 34 is supplied with the pressure prevailing in the high-pressure accumulator 2 via the supply line 9, the check valve 43, the inlet 29 to the compression chamber 15, and the line connection branching from it that contains the throttle restriction 30. The compression chamber 15 of the pressure booster is filled with highly pressurized fuel via the inlet 29 that branches off from the supply line 9 downstream of the check valve 43 in terms of the fuel flow direction.

In the normal state of the fuel injector proposed according to the invention, i.e. the idle state shown in FIG. 1, all of the pressure chambers 10, 11, and 15 of the pressure booster 5 are acted on with the pressure level prevailing in the high-pressure accumulator 2 and the pressure booster 5 is in a pressure-balanced state. In this state, the end surface of the first piston part 13 rests against the support ring 16 that is fitted into the injector body 3 and functions as a stop element. In this state, the pressure booster 5 is inactive and no pressure boosting occurs. In this state, the return spring 17 holds the piston unit 12 of the pressure booster in the closed position when all of the pressure chambers 10, 11, and 15 of the pressure booster are acted on with the pressure level prevailing in the high-pressure accumulator 2 (rail pressure).

The rail pressure prevailing in the hydraulic chamber 31 in the nozzle body 4 exerts a hydraulic closing force on the end surface 35 of the injection valve element 34, which is preferably embodied in the form of a nozzle needle. In addition to this, a spring force acts on the end surface 35 of the injection valve element 34 in the closing direction, exerted by the spring element 33 embodied for example as a coil spring contained in the hydraulic chamber 31. Therefore the pressure prevailing inside the high-pressure accumulator 2 (rail pressure) can always be present in the nozzle chamber 28 encompassing the injection valve element 34 in the form of a ring in the region of a pressure shoulder 38, without the injection valve element 34 moving vertically into the hydraulic chamber 31 and thus unintentionally opening the injection openings 35 into the combustion chamber 7 of the autoignition internal combustion engine.

If the pressure booster 5 is triggered, then there is an increase in the pressure prevailing in the compression chamber 15, the nozzle chamber 28, and the hydraulic chamber 31 since the pressure prevailing in the control chamber 11 of the pressure booster 5 decreases because the triggering of the metering valve 6 connects the control line 26 to the low-pressure return 8 and the control volume contained in the control chamber 11 flows into this return 8. However, this does not lead to the opening of the injection valve element 34 inside the nozzle body 4, which valve element is preferably embodied as a nozzle needle, because the pressure difference between the nozzle chamber 28 and the hydraulic chamber 31 is not yet of sufficient magnitude. Only when there is an active pressure relief of the hydraulic chamber 31 does the injection valve element 34 open, i.e. its end surface 35 travels into the hydraulic chamber 31 in the upper region of the nozzle body 4 of the fuel injector 1.

In order to produce an active pressure relief of the hydraulic chamber 31 in the upper region of the nozzle body 4 of the fuel injector 1, control sections 19 and 21 are embodied at the end of the second piston part 14 of the piston 12 oriented toward the compression chamber 15 of the pressure booster 5. In the embodiment variant shown in FIG. 1, the control sections 19 and 21 are disposed one after the other in the stroke direction of the first piston part 14 in the compression chamber 15 of the pressure booster 5. The circumferential surface of the second piston part 14 is embodied with a control section 19 whose diameter is smaller than the outer diameter of the first piston part 14; this control section 19 extends for a first axial length 19.1 in the stroke direction of the second piston part 14. The additional control section 21 is separated from the control section 19 by a collar. The collar that separates the control section 19 from the additional control section 21 is embodied with the first diameter of the first piston part 14. The axial length 21.1 of the additional control section 21 is considerably shorter than the axial length 19.1 of the control section 19. Whereas the control section 19 is embodied as an annular chamber, the additional control section 21 is embodied, for example, in the form of an annular groove as compared to the control section 19.

At the collar on the first piston part 14, the control section 19 is delimited by a control edge 20, whereas on the other side of the collar at the outer circumference of the first piston part 14, a second control edge 22 delimits the additional control section 21.

Instead of the two control sections 19 and 21 disposed one after the other in the stroke direction of the first piston part 14 shown in FIG. 1, there can also be three control sections disposed one after another in the provided stroke direction of the first piston part 14 as it plunges into the compression chamber 15 of the pressure booster 5, the number of control sections corresponding to a number of injection events to be executed in the combustion chamber 7 in the context of a multiple injection.

The junction points 24 of the overflow line 41 to the control chamber 11 of the pressure booster 5 and the branching point 25 of the connecting line 32 that connects the compression chamber 15 to the hydraulic chamber 31 are disposed opposite each other in the compression chamber 15.

The active pressure relief of the hydraulic chamber 31 in the nozzle body 4 of the fuel injector is executed by means of an insertion movement of the first piston part 14 into the compression chamber 15. If the second piston part 14 has traveled a certain stroke distance, then the additional control section 21, which can be embodied as an annular groove, connects a cross section between the hydraulic chamber 31 and the connecting line 32 on the one hand and the overflow line 41 into the control chamber 11 and the control line 26 to the low-pressure return 8 on the other. As a result, depending on the axial length 21.1 of the additional control section 21, the hydraulic chamber 31 can be set to low pressure, thus decreasing the force acting on the end surface 35 of the injection valve element 34 so that the injection valve element 34 can no longer be held in its closed position. Because of the hydraulic force prevailing in the nozzle chamber 28 and acting on the pressure shoulder 38 of the injection valve element 34, the injection valve element 34 opens and unblocks the injection openings 39 feeding into the combustion chamber 7 of the autoignition internal combustion engine. From the beginning, the injection pressure is higher than the pressure prevailing inside the high-pressure accumulator 2 (rail pressure). A higher injection pressure favorably affects a reduction of the emissions of an autoignition internal combustion engine as well as the production of higher specific outputs. This permits the best possible conversion of the energy inherent in the fuel.

In order to be able to produce a small preinjection quantity in the context of a multiple injection, the hydraulic chamber 31 that acts on the end surface 35 of the injection valve element 34 cannot be connected to the low-pressure return 8 for too long. The desired preinjection quantity can be influenced by means of the axial length 21.1 of the additional control section 21. In the embodiment variant shown in FIG. 1, the axial length 21.1 of the additional control section 21 is dimensioned precisely so as to permit an overflow of fuel from the hydraulic chamber 31 via the connecting line 32 into the overflow line 41 and from there, via the control chamber 11 into the control line 26. As soon as the additional control section 21, with further pressure relief of the control chamber 11, travels into the compression chamber 15 of the pressure booster 5, the collar between the control section 19 and the additional control section 21 breaks the fluid connection between the connecting line 32 and the overflow line 41 into the control chamber 11. The hydraulic chamber 31 and the connecting line 32 are therefore disconnected by the collar from the overflow line 41, the control chamber 11, and the overflow line 26 branching off from it and leading to the low-pressure return 8. For hydraulic reasons, it is advantageous if the openings of the overflow line 41 and the connecting line 32 feed into the bore in which the piston unit 12 travels. In the position shown in FIG. 1, in which the piston unit 12 is resting against its upper stop 16, i.e. the support ring, the openings of the connecting line 32 and the overflow line 41 are covered over by the collar between the end surface 23 and the control section 21. As a result, the boosted pressure builds up in the hydraulic chamber 31 and closes the injection valve element 34, aided by the spring 33 contained in the hydraulic chamber 31. Since the pressure booster 5 continues to remain actuated and the end surface 23 of the second piston part 14 therefore continues to travel into the compression chamber 15, the control section 19 comes to coincide with the junction point 24 of the overflow line 41 and the branch point 25 of the connecting line 32 to the hydraulic chamber 31. As a result, in accordance with the axial length 19.1 of the control section 19, a longer-lasting pressure relief of the hydraulic chamber 31 in the nozzle body 4 occurs so that an additional, longer-lasting injection can take place. Depending on the dimensions of the axial lengths 19.1 and 21.1 of the control sections 19 and 20, this can be an additional preinjection or a longer-lasting main injection phase. The main injection phase is terminated by either a deactivation of the pressure booster 5 or by the control edge opposite from the first control edge 20 of the control section 19 closing and therefore breaking the fluid connection between the junction points 25 and 24 of the lines 41 and 32.

In order to terminate the injection event, the pressure in the nozzle chamber 28 is reduced to the pressure level prevailing in the high-pressure accumulator 2. To this end, the metering valve 6 preferably embodied in the form of a 2/2-way valve disconnects the control chamber 11 of the pressure booster 5 from the low-pressure return 8. As a result, the control chamber 11 is acted on by the pressure level prevailing in the high-pressure accumulator 2 (common rail), which effectively prevails from the working chamber 10 to the control chamber 11 of the pressure booster 5 via the throttle restriction 40 provided in the first piston part 13 of the piston 12. As a result, the rail pressure level builds up in the control chamber 11 of the pressure booster 5 since it is no longer connected to the low-pressure return 8 via the control line 26. In this state, the metering valve 6 preferably embodied in the form of a 2/2-way valve is moved into its closed position shown in FIG. 1. The pressure in the compression chamber 15, the nozzle chamber 28, and the hydraulic chamber 31 drops to the rail pressure level. Since the pressure prevailing in the high-pressure accumulator 2 now also prevails in the hydraulic chamber 31, the injection valve element 34 is hydraulically balanced and the spring force of the spring element 34 acting on the end surface 35 of the injection valve element 34 moves the injection valve element 34 into its closed position, closing the injection openings 39 at the needle tip 37 of the injection valve element 34. This terminates the injection of highly pressurized fuel into the combustion chamber 7 of the autoignition internal combustion engine.

After the pressure balancing, the action of the return spring 17, which acts on a stop 18 on the second piston part 14, moves the piston 12 of the pressure booster 5 back into the starting position; the compression chamber 15 is filled with fuel again via the inlet line 29 branching from the supply line 9. The hydraulic chamber 31 is refilled with fuel via the supply line 9, which can contain a check valve 43 that damps pressure pulsations, via the inlet 29 to the compression chamber 15, and via the line that branches from it and contains the throttle restriction 30.

In order to stabilize switching sequences with the fuel injector with pressure booster 5 proposed according to the invention, additional steps can be taken in order to damp the oscillations between the high-pressure accumulator 2 (common rail) and the fuel injector 1. The check valve 43 can be disposed directly downstream of or at the junction point into the high-pressure accumulator 2. Instead of a check valve 43, a throttle element can also be provided there. When the pressure booster 5 is actuated, the check valve 43 or a throttle element provided in its place disconnects the high-pressure accumulator 2 from the compression chamber 15, from the lines 29 and 27, and from the nozzle chamber 28.

The embodiment proposed according to the invention combines a simply designed 2/2-way valve, which is embodied as a metering valve 6, with a pressure booster piston part that is provided with several control sections disposed one after another in the stroke direction of the piston part. On the one hand, this makes it possible to avoid using a complex, expensive-to-produce 3/2-way valve and on the other hand, permits the simple production of preinjection phases, main injection phases, and secondary injections in the context of a discharge rate curve shaping process. Furthermore, instead of using two solenoid valves, the design according to the invention makes it possible to use a single metering valve 6. The control sections 19 and 21 in the lower region of the second piston part 12 of the pressure booster 5 are easy to produce.

The foregoing relates to preferred exemplary embodiments of the invention, it being understood that other variants and embodiments thereof are possible within the spirit and scope of the invention, the latter being defined by the appended claims.

What is claimed is:

1. A device for injecting fuel into a combustion chamber (7) of an internal combustion engine, comprising a high-pressure accumulator (2), a pressure booster (5), a metering valve (6), the pressure booster (5) having a working chamber (10) and a control chamber (11) separated from each other by an axially moving piston (12; 13, 14), a pressure change in the control chamber (11) of the pressure booster (5) causing a pressure change in a compression chamber (15) of the pressure booster (5), the compression chamber (15) communicating with a hydraulic chamber (31) associated with an injection valve element (34), and control sections (19, 21) provided on the piston (12; 13, 14) that acts on the compression chamber (15) of the pressure booster (5) for relieving the pressure in the hydraulic chamber (31) of the injection valve element (34).

2. A device for injecting fuel according to claim 1, wherein the hydraulic chamber (31) can be temporarily pressure relieved.

3. The device for injecting fuel according to claim 1, wherein the control sections (19, 21) are embodied on the circumference of a piston part (13, 14) of the piston unit (12) and are disposed one after the other in the stroke direction of the piston unit (12).

4. The device for injecting fuel according to claim 2, wherein at least two control sections (19, 21) are embodied on the circumference of the piston part (14) of the piston unit (12) that acts on the compression chamber (15).

5. The device for injecting fuel according to claim 1, further comprising an overflow line (41) that communicates with the control chamber (11) of the pressure booster (5) feeding into the bore in which the piston unit (12) travels.

6. The device for injecting fuel according to claim 1, wherein the bore in which the piston unit (12) travels communicates with the hydraulic chamber (31) via a connecting line (32).

7. The device for injecting fuel according to claim 5, wherein the bore in which the piston unit (12) travels communicates with the hydraulic chamber (31) via a connecting line (32), and wherein the junction point (24) of the overflow line (41) and the branching point (25) of the connecting line (32) are disposed opposite from each other in the compression chamber (15).

8. The device for injecting fuel according to claim 3, further comprising a collar separating the control sections (19, 21) from each other in the axial direction of the second piston part (14).

9. The device for injecting fuel according to claim 1, wherein the control section (19, 21) disposed closest to the compression chamber (15) is embodied in the form of an annular groove.

10. The device for injecting fuel according to claim 1, wherein the control section (19, 21) disposed closest to the control chamber (11) of the pressure booster (5) is embodied as an annular chamber.

11. The device for injecting fuel according to claim 9, wherein the control section (19, 21) disposed closest to the control chamber (11) of the pressure booster (5) is embodied as an annular chamber, and wherein the axial lengths (19.1, 21.1) of the control sections (19, 21) are the same in the stroke direction of the piston unit (12; 13, 14).

12. The device for injecting fuel according to claim 9, wherein the control section (19, 21) disposed closest to the control chamber (11) of the pressure booster (5) is embodied as an annular chamber, and wherein the axial lengths (19.1, 21.1) of the control sections (19, 21) are different in the stroke direction of the piston unit (12; 13, 14).

13. The device for injecting fuel according to claim 6, further comprising a line containing a throttle restriction (30) and connected in parallel with the connecting line (32) between the compression chamber (15) and the hydraulic chamber (31).

14. The device for injecting fuel according to claim 1, further comprising a control line (26), which contains a 2/2-way valve as a metering valve (6), whereby the control chamber (11) can be pressure relieved into the low-pressure side (8).

15. The device according to claim 1, wherein the supply line (9, 42, 29, 27) to the working chamber (10), the compression chamber (15), and the nozzle chamber (28) contains a check valve (43) that disconnects the high-pressure section (15, 29, 27, 28) form the high-pressure accumulator (2) when the pressure booster (5) is activated.

16. The device for injecting fuel according to claim 1, wherein the piston unit (12; 13, 14) of the pressure booster (S) comprises a first piston part (13), which contains a throttle restriction (40) that connects the working chamber (10) to the control chamber (11) of the pressure booster, and a second piston part, the control sections (19, 21) being embodied on the second piston part (14) of the piston unit (12) whose end surface (23) acts on the compression chamber (15) of the pressure booster (5).

* * * * *